United States Patent [19]

Weisang et al.

[11] Patent Number: 5,054,749

[45] Date of Patent: Oct. 8, 1991

[54] TUNDISH FOR CONTINUOUS CASTING OF STEEL

[75] Inventors: Francois Weisang, Antony; Pierre Charlery-Adele, Maurepas, both of France

[73] Assignee: L'Air Liquide, Societe Anonyme pur l'Etude et l'Exploitation des Procedes Georges Claude, Paris, France

[21] Appl. No.: 537,704

[22] Filed: Jun. 14, 1990

[30] Foreign Application Priority Data

Jun. 16, 1989 [FR] France ..... 89 08008

[51] Int. Cl.[5] ..... C21C 5/48

[52] U.S. Cl. ..... 266/220; 266/217; 266/275

[58] Field of Search ..... 266/217, 218, 220, 265, 266/216, 275; 222/603

[56] References Cited

U.S. PATENT DOCUMENTS 1,057,489 4/1913 Mark ..... 266/220
1,763,248 6/1930 Moore ..... 266/220
4,360,190 11/1982 Ato ..... 266/220
4,903,948 2/1990 Wolf et al. ..... 266/220

FOREIGN PATENT DOCUMENTS 2655912 6/1978 Fed. Rep. of Germany .
2148765 6/1985 United Kingdom .
2157210 10/1985 United Kingdom .

*Primary Examiner*—S. Kastler
*Attorney, Agent, or Firm*—Young & Thompson

[57] ABSTRACT

Tundish for continous casting of steel, of the type comprising a permanent refractory, cast on a frame of sheet metal defining the outer wall of the tundish and on which a refractory wear has been laid. In the body of the permanent refractory, there is provided a gas duct which penetrates into the permanent refractory at the level of the upper edge of the tundish and extends to the bottom of the tundish into a gas distribution chamber, which is covered with a surface distributed gas permeable plate. Application to the continuous casting of steels for tundish between casting ladle and ingot molds.

12 Claims, 2 Drawing Sheets

TUNDISH FOR CONTINUOUS CASTING OF STEEL

BACKGROUND OF INVENTION (a) Field of the Invention

The invention concerns a tundish for the continuous casting of a steel between ladle and ingot molds.

(b) Description of Prior Art

Tundishes for continuous casting of steel are made of a refractory which has been cast with substantial thickness on a frame of sheet metal defining the outer wall of the tundish and on which has been laid a wear refractory which is restored after each operation.

In order to satisfy increasing requirements on the quality of cast products, steel makers use the tundish as a metallurgical tool which also permits to render the temperature and the composition of the liquid metal uniform and to eliminate all or part of the remaining inclusions. For this purpose, many improvements have enabled to improve the flow of liquid metal, and this has been made possible by modifying the geometry and adding dams (small walls, baffles...). It has also been found that injections of neutral gas (argon, helium, nitrogen...) are complementary to the present means used to improve the metallurgy of the tundish.

If the injection of neutral gas in a liquid metal is now very much in use in ladle metallurgy, the characteristics required from a gas injector in a tundish are substantially different, since in addition to metallurgical requirements, safety requirements and costs limitations are also involved. For these reasons, the techniques used in ladle such as porous plugs and lances cannot be directly transposable. Indeed, on the one hand metallurgical considerations require gas bubbles which are as small as possible through an important part of an injection surface and with a distribution which is as good as possible. In addition, maintenance of this injector should be easy to implement so as not to increase the costs of operation on the tundish. The excess cost involved by this technique depends on the number of tons which are being cast (from 30 t to 1000 t depending on machines used and the lengths of the operations). The tundish is normally placed on a carrier at man's height, on the casting floor, so as to make it possible to have access to the ingot molds. For the safety of the operators, any tapping should therefore be definitely prevented.

SUMMARY OF THE INVENTION

These objects are achieved, according to the invention, by providing, in the body of said permanent refractory having extra thickness, means for gaseous injection containing a permanent part expanding at the level of the bottom of the tundish into a gaseous distribution chamber in which an upper perforated wall is at the level of the bottom of the permanent refractory of the tundish, and a renewable part in the form of a gas permeable wear refractory plate surmounting and extending over said gaseous distribution chamber.

This embodiment enables to constitute a simple tundish by means of a duct which is embedded in the body of the refractory, and which opens upwards, without any risk of perforation such as at the bottom of the tundish, with a simple gas permeable refractory plate which is the only part that should be changed after each casting operation.

According to a preferred embodiment, the distribution chamber extends longitudinally transversly of the bottom of the tundish.

The gas permeable refractory plate surmounting the gaseous distribution chamber is formed of a plate of porous refractory material.

The upper wall of the gaseous distribution chamber advantageously comprises a plate of dense refractory material provided with a plurality of predistributed perforations. The distributed perforations of the upper wall of the distribution chamber are made by the technique of through inserts disposed before casting the refractory material forming said chamber upper wall, said inserts being either tubular and mounted permanently, or rod-like such as wires which are thereafter removed before use.

The gaseous distribution chamber is either directly formed by a recess provided in the permanent refractory of the tundish, or comprises a casing of sheet iron placed and sealed in a corresponding recess of the bottom refractory material of the tundish and in this case, the casing of sheet iron is either open at its upper portion and is sealingly covered by the upper refractory wall with distributed perforations of the chamber, or is closed at its upper end by means of a perforated wall which can itself be covered with a plate of dense refractory material with distributed perforations.

Preferably, the gaseous distribution chamber is supplied through a pipe embedded in a lateral wall of the tundish and the feeding pipe of the gaseous distribution chamber is longitudinally engaged for the most part inside the distribution chamber.

BRIEF DESCRIPTION OF DRAWINGS

The characteristics and advantages of the invention will, on the other hand, appear from the description which follows, given by way of example, with reference to the annexed drawings in which.

DESCRIPTION OF PREFERRED EMBODIMENTS

Figure 1:
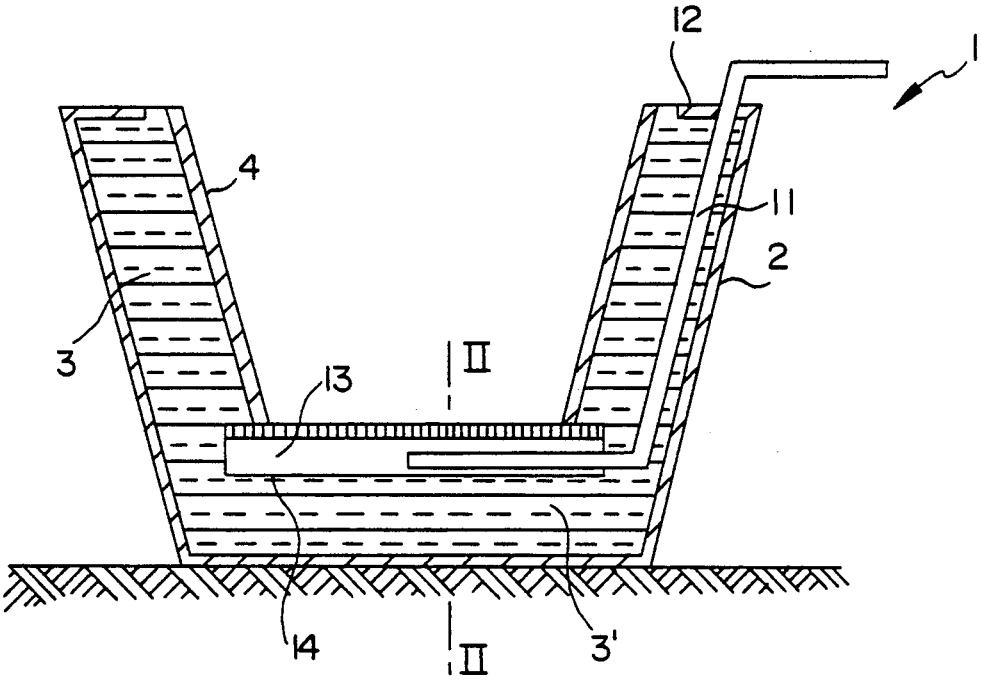
FIG. 1 is a transverse cross-section view of a tundish according to the invention.
Figure 2:
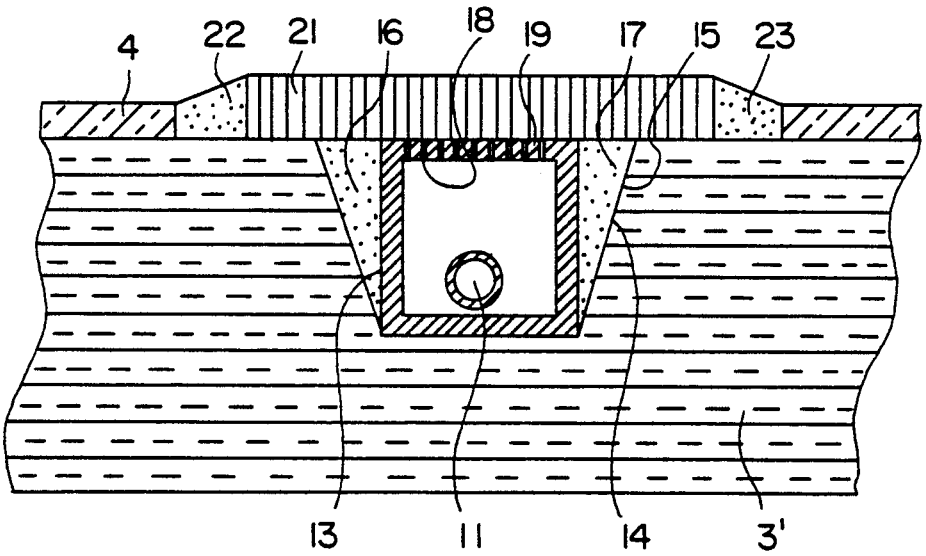
FIG. 2 is a cross-section view, on an taken along line II—II of FIG. 1.

With reference to FIG. 1, a tundish consists of a rigid metallic outer casing, on which is cast a thick wall 3 of permanent dense refractory material which, itself, is thereafter provided with a so-called wear lining, of refractory material 4. When casting the wall 3, there is provided at least one gas inlet duct 11 opening through the upper edge 12 of the tundish 1 and horizontally engaging substantially in a bottom distribution box 13 mounted in a transverse recess 14 with sloping edges 15 of the bottom refractory wall 3', said box 13 being sealed by means of a filling cement 16 and 17. Upper wall 18 of box 13 is provided with a plurality of uniformly distributed fine holes 19 and the assembly is covered with gas permeable plate 21 of porous refractory material which rests on the refractory 3 in covering fashion and is bound through cement seals 22 and 23 with the wear lining 4.

The gas distribution chamber 13 is placed in a recess provided in the permanent refractory, wherein the thickness of the refractory below the chamber is sufficient to prevent any danger of perforation in the case where liquid metal would spread in this recess 14. The sealing cement 16/17 ensures a good adhesion between concrete and chamber. The dimension of the porous plate 21 is such that it exceeds on each side so as to ensure that there is a good imperviousness to gas between concrete 3' and plate 21 (a refractory coating can be used as a glue on the portion of the plate in contact with concrete). Plate 21 is thereafter either sealed at the bottom of the tundish by means of a cement 22-23, or embedded in the thickness of the wear refractory 4. The mounting of this plate 21 is carried out before laying the wear lining 4 and during this operation, its upper surface through which gas is allowed to pass is protected by means of a sheet of plastic or cardboard during this operation.

The porous plate 21 is made of: either a porous refractory of the same type as that of the porous plugs used in metallurgy (consisting of a mixture of granular particles of refractory materials with fixed granulometry distribution, forming a slab which is thereafter fritted at high temperature); either a refractory whose porous character has been obtained by adding to the raw paste a product which disappears when baking; either a non-baked plate of the same type as those who are provided with the tundishes of the so-called "cold with plates" type (a fine "icy" layer is formed when contacting the liquid metal but leaves passages for the gas if care has been taken to keep a flow of gas through the latter before contact of the tundish with metal).

In order to reduce the cost of this plate which wears out at each liquid metal casting, it is recommended to determine the thickness of the latter as a function of the duration of the operation (for example this plate will have low thickness for casting a single ladle).

Figure 3:
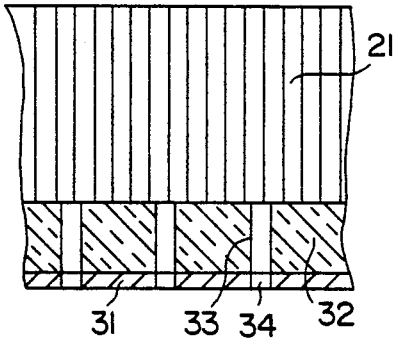
FIGS. 3 and 4 are partial views, on enlarged scales, of a variant of the embodiment according to FIG. 2.
Figure 4:
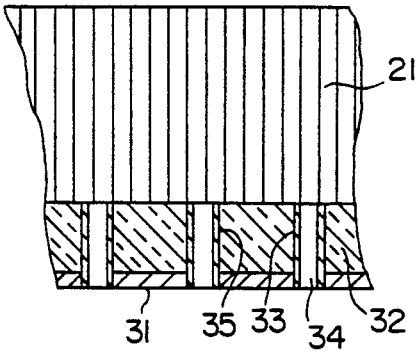
Figure 5:
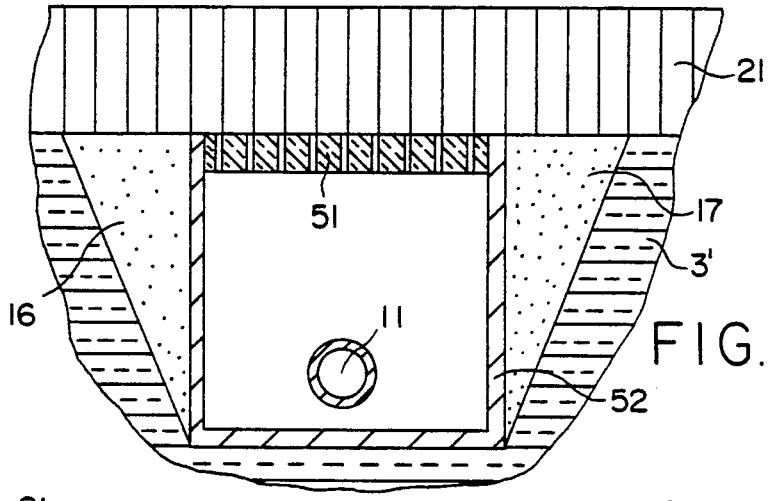
FIGS. 5, 6 and 7 are three other variants.
Figure 6:
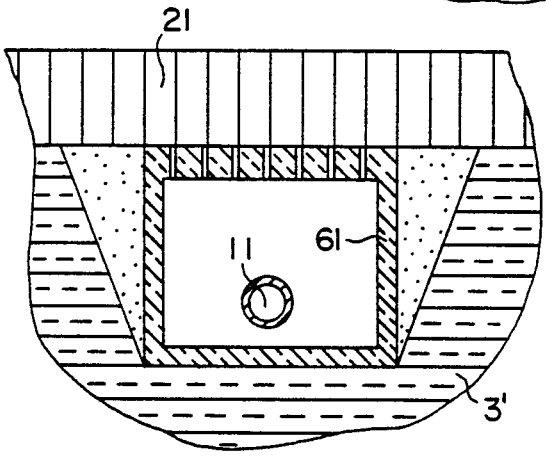
Figure 7:
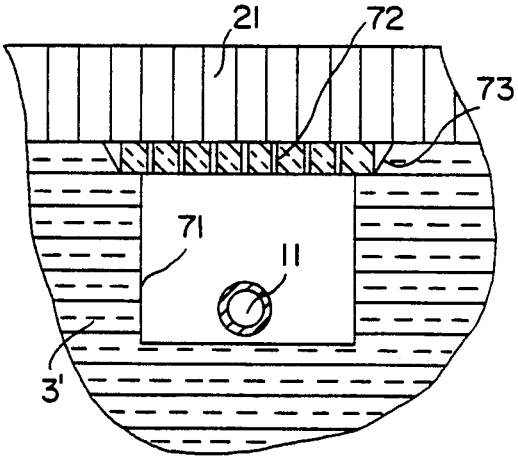

The distribution chamber 14 in the form of a box of sheet metal has a length which is equal to the width of the bottom of the tundish 1 and is sufficiently wide to ensure a good efficiency of the process. In some cases, many gaseous distribution chambers can be provided in parallel. The upper wall 18 is made of a sheet metal provided with equally distributed holes. According to FIG. 3, this sheet 31 is protected by a portion of dense refractory material 32 in which are provided gas passages 33. Correspondence of the holes 34 of the sheet metal 31 with gas passages 33 through this refractory is obtained either by providing inserts in the form of metallic tubes 35 set in the sheet metal (FIG. 4) or by placing portions of wires in these holes 34 which will be removed after the initial setting of the refractory or destroyed during baking (obtention of a directed porosity). A variant (FIG. 5) consists in using this refractory plate 51 as cover and thus takes out the upper sheet metal from the distribution box 52. In this case, it is necessary to provide such an imperviousness at the junction sheet metal 52 - plate 51, that any preferential passage of the gas at the periphery is prevented. Two other variants consist in making the distribution chamber 61 entirely of dense refractory material (FIG. 6), or even in using the recess 71 provided in the permanent refractory and in sealing a perforated concrete plate 72 in a sheet 73 (FIG. 7).

It should be noted that the diameter of the passages in the upper plate is smaller or equal to 1 mm so as to prevent any penetration of metal in the distribution chamber in the case where the porous plate would be destroyed.

We claim:

1. Tundish for continuous casting of steel, comprising a permanent refractory cast on a sheet metal frame defining an external all of the tundish and on which a refractory wear lining is laid, wherein gaseous injection means are provided in the body of said permanent refractory, said gaseous injection means comprising at the level of the bottom of the tundish a gaseous distribution chamber being at the level of the bottom of the permanent refractory of the tundish, a renewable part in the form of a gas permeable refractory wear plate surmounting and extending over said gaseous distribution center, and a gas inlet duct opening through an upper edge of the tundish and extending down through the permanent refractory of said distribution chamber to supply gas to said distribution chamber.

2. Tundish for continuous casting of steel according to claim 1, wherein the gaseous distribution plate is unitary with the refractory wear lining of the tundish.

3. Tundish for continuous casting of steel according to claim 1, which comprises a gas permeable refractory plate surmounting the gas distribution chamber, said refractory plate being formed of a plate of porous refractory material.

4. Tundish for continuous casting of steel according to claim 1, wherein the upper wall of the gas distribution chamber comprises a plate of dense refractory material provided with a plurality of pre-distributed perforations.

5. Tundish for continuous casting of steel according to claim 4, wherein the pre-distributed perforations provided in the upper wall of the distribution chamber are made by providing through inserts disposed before casting refractory material forming said upper wall of said chamber, said inserts being either tubular and permanently mounted, or unitary such as wires and thereafter removed before being used.

6. Tundish for continuous casting of steel according to claim 1, wherein the gas distribution chamber is formed directly by dividing a recess in the permanent refractory of the tundish.

7. Tundish for continuous casting of steel according to claim 1, wherein the gas distribution chamber is formed of a casing of sheet iron placed and sealed in a corresponding recess of the bottom refractory material of the tundish.

8. Tundish for continuous casting of steel according to claim 7, wherein the sheet iron casing is opened at its upper end and is sealingly covered by the upper refractory wall with distributed perforations of the chamber.

9. Tundish for continuous casting of steel according to claim 7, wherein the casing of sheet iron is closed at its upper end by means of a perforated wall.

10. Tundish for continuous casting of steel according to claim 4, wherein the upper perforated wall of the casing is covered with a plate of dense refractory material having distributed perforations.

11. Tundish for continuous casting of steel according to claim 10, wherein the upper perforated wall of the casing is covered with a plate provided with holes aligned with the holes of the upper wall of the casing.

12. Tundish for continuous casting of steel according to claim 11, wherein the sheet metal wall of the casing has projecting means opposite each performation of the wall to form, during casting, the extended perforations of the refractory defining the upper wall of the chamber.

* * * * *